US005945347A

United States Patent [19]

Wright

[11] Patent Number: 5,945,347

[45] Date of Patent: Aug. 31, 1999

[54] APPARATUS AND METHOD FOR POLISHING A SEMICONDUCTOR WAFER IN AN OVERHANGING POSITION

[75] Inventor: David Q. Wright, Boise, Id.

[73] Assignee: Micron Technology, Inc., Boise, Id.

[21] Appl. No.: 08/460,125

[22] Filed: Jun. 2, 1995

[51] Int. Cl.[6] ..... H01L 21/00

[52] U.S. Cl. ..... 438/692; 156/345; 216/88; 438/747

[58] Field of Search ..... 156/345 LP; 216/38, 216/88, 89, 91; 438/690, 691, 692, 693, 747

[56] References Cited

U.S. PATENT DOCUMENTS

| | | |
|---|---|---|
| Re. 34,425 | 11/1993 | Schultz . |
| 5,081,796 | 1/1992 | Schultz . |
| 5,194,344 | 3/1993 | Cathey, Jr. et al. . |
| 5,197,999 | 3/1993 | Thomas . |
| 5,212,910 | 5/1993 | Breivogel et al. . |
| 5,245,790 | 9/1993 | Jerbic . |
| 5,257,478 | 11/1993 | Hyde et al. . |
| 5,302,233 | 4/1994 | Kim et al. . |
| 5,310,455 | 5/1994 | Pasch et al. . |
| 5,314,843 | 5/1994 | Yu et al. . |
| 5,329,734 | 7/1994 | Yu . |
| 5,593,537 | 1/1997 | Cote et al. ..... 156/345 X |

FOREIGN PATENT DOCUMENTS 6-97132 4/1994 Japan .

*Primary Examiner*—William Powell
*Attorney, Agent, or Firm*—Fletcher, Yoder & Van Someren

[57] ABSTRACT

An apparatus and method for preventing gimballing in the polishing of a semiconductor wafer held in an overhanging position with respect to a polishing pad. One embodiment includes a support apparatus for use with a device for polishing a semiconductor wafer, the device having a rotatable wafer carrier and a polishing pad attached to a rotatable platen, the wafer carrier being movable to place a semiconductor wafer held by the wafer carrier in a contacting and overhanging relationship with the polishing pad. The support apparatus includes a support to prevent gimballing of the wafer carrier when the wafer held by the wafer carrier is in the overhanging and contacting relationship with the polishing pad, the support having a low polishing surface to contact and support the semiconductor wafer. Another embodiment includes a supporting pad for use with a polishing pad, the supporting pad including a ring having an inner diameter greater than the outer diameter of the polishing pad, the ring having a supporting surface of a material with low polishing characteristics. A method for assembling polishing pads to a circular platen and a process for polishing a semiconductor wafer are also disclosed.

20 Claims, 6 Drawing Sheets

APPARATUS AND METHOD FOR POLISHING A SEMICONDUCTOR WAFER IN AN OVERHANGING POSITION

BACKGROUND OF THE INVENTION

1. Field of the Invention

This invention relates to the field of polishing semiconductor wafers in the fabrication of integrated circuits, and more particularly to the field of polishing semiconductor wafers in an overhanging relationship with a polishing surface.

2. Statement of the Problem

Integrated circuits are generally mass produced by fabricating hundreds of identical circuit patterns on a single semiconductor wafer that is subsequently divided into hundreds of identical dies or chips. While sometimes referred to as "semiconductor devices", integrated circuits are in fact fabricated from various materials that are either electrically conductive, non-conductive, or semiconductive. Silicon, the most commonly used semiconductor material, can be used in either the single crystal or polycrystalline form. Both forms of silicon may be made conductive by adding impurities to it, which is commonly referred to as "doping." Likewise it is common practice to modify other materials, such as conductors or insulators, by adding other components. Alternatively, one material, such as silicon, may be removed or replaced by another. Processes commonly used to modify, remove, or deposit a material are ion implantation, sputtering, etching, chemical vapor deposition (CVD) and variations thereof, such as plasma enhanced chemical vapor deposition (PECVD).

The above-discussed processes are often selectively applied to an integrated circuit through the use of a masking process. In the masking process, a photo-mask containing the pattern of the structure to be fabricated is created, and the wafer is coated with a light-sensitive material called photoresist or resist. Then, the resist-coated wafer is exposed to ultraviolet light through the photo-mask to soften or harden parts of the resist depending on whether positive or negative resist is used. Once the softened parts of the resist are removed, the wafer is treated by one of the processes discussed above to modify, remove, or replace the part unprotected by the resist, and then the remaining resist is stripped. This masking process permits specific areas of the integrated circuit to be modified, removed, or replaced.

These steps of deposition or removal are frequently followed by a planarization step such as chemical mechanical planarization (CMP). This planarization process helps to minimize barriers to multilayer formation and metallization, as well as to smooth, flatten, and clean the surface. This process involves chemically etching a surface while also mechanically grinding or polishing it. The combined action of surface chemical reaction and mechanical polishing allows for a controlled, layer by layer removal of a desired material from the wafer surface resulting in the preferential removal of protruding surface topography and a planarized wafer surface. In the past few years, CMP has become one of the most effective techniques for planarizing all or a portion of a semiconductor wafer.

In general, the CMP process involves holding a semiconductor substrate, such as a wafer, against a rotating wetted polishing pad under controlled downward pressure. A polishing slurry metered onto the polishing pad contains etchants and an abrasive material such as alumna or silica. A rotating wafer carrier is typically utilized to hold the wafer under controlled pressure against a rotating polishing platen covered with the polishing pad typically formed of a relatively soft material such as a felt fabric impregnated with blown polyurethane. The CMP process is well known (See, for example, U.S. Pat. No. 5,302,233 to Kim et al. and U.S. Patent Re. 34,425 to Schultz).

One problem associated with the CMP process is that the semiconductor wafer may be subjected to non-uniform planarization due to the relative velocity differential between the outer peripheral portions and the interior portions of the rotating wafer and due to the relative velocity differential between these portions of the wafer and the polishing pad. On a rotating disk, the linear velocity of a point along a radial line increases linearly with the distance from the center (the velocity of a point being equal to the angular velocity multiplied by the distance of the point from the center). It is known that the rate of material removal by a polishing surface from a workpiece is associated with the relative linear velocity between the points of contact between the two surfaces. For example, assuming that the polishing surface were stationary, the faster moving peripheral portions of the semiconductor wafer would experience a relatively larger rate of material removal than the relatively slower moving interior portions. This problem of uneven material removal would be accentuated if the polishing surface were rotated and the peripheral portion of the wafer and the peripheral portion of the rotating polishing surface coincided. Therefore, in order to insure a more consistent rate of polishing, it is advantageous to "overhang" the wafer with respect to the polishing surface so that the slower moving central portions of the wafer are exposed to the faster moving peripheral portions of the polishing surface, and, correspondingly, the faster moving peripheral portion of the wafer is exposed to the more central, slower moving portion of the polishing surface. The overhanging relationship of the wafer to the polishing pad results in a more consistent relative velocity between the points of contact between the wafer and polishing pad across the surface of the wafer. The problem of irregularities caused by inconsistent relative velocities across the surface of the wafer exists whether the polishing platen and wafer are rotated in the same direction or in opposite directions of rotation. The advantage of overhanging the wafer with respect to the polishing platen was discussed in U.S. Pat. No. 5,081,796 (Re. 34,425) to Schultz.

However, while the overhanging arrangement partially solves the problem of polishing irregularities due to the difference in the relative linear velocities, the overhanging arrangement creates a different problem. In many of the devices for polishing wafers, the wafer carrier has a slight angular rotation about an axis perpendicular to its primary axis of rotation. This rotation about an axis perpendicular to the primary axis of rotation is defined as "gimballing." When the center of gravity of the wafer and wafer carrier overhang the polishing pad, gravity will cause gimballing because the wafer is not evenly supported across its face. Furthermore, the outer periphery of the prior art polishing pad wears faster than the inner portion. This uneven wear at the periphery of the polishing pad further enhances and encourages gimballing.

Gimballing results in a lack of homogeneous planarization that can result in some material not being removed (i.e., under polishing), in some material being removed that was not intended to be removed (i.e., over polishing), or both. Further, since the subsequent processes assume or even require a planar wafer surface, this lack of planarization can alter the properties and parameters of the device. All of these results contribute to defective devices, loss of device yield, and lack of device reliability. Thus, there exists a need for apparatus and methods to improve the uniformity of planarization in the CMP process where the wafer is placed in an overhanging relationship with the polishing pad.

Generally, a change in one phase of the integrated fabrication process usually impacts other phases. Since integrated circuit fabrication processes are highly complex and require sophisticated equipment, developments of entirely new processes and materials can be quite costly. Thus, new apparatus and methods for control of the CMP process that can be incorporated into current fabrication technology would be highly desirable to avoid expensive modification of equipment and processes. Therefore, a need further exists to eliminate the problem of gimballing without substantially modifying the proven processes and equipment in place.

A cost effective solution is needed to provide support to the wafer in an overhanging position without significantly polishing the wafer in the region overhanging the polishing pad. One cost effective solution would be to design a polishing pad to provide support across the face of the wafer but which does not polish. Various designs exist for polishing pads. Exemplary of prior art polishing pads are the following U.S. Pat. No. 5,329,734 to Yu, U.S. Pat. No. 5,310,455 to Pasch et al., U.S. Pat. No. 5,257,478 to Hyde et al., U.S. Pat. No. 5,212,910 to Breivogel et al., U.S. Pat. No. 5,197,999 to Thomas. (See also Japanese Patent No. 6-97132). Only the Yu, U.S. Pat. No. 5,329,734, discloses a polishing pad specifically designed to compensate for the polishing nonuniformity caused by the difference in relative velocities between the edge of the wafer and the center of the wafer.

Yu discloses a polishing pad having a first region lying closer to the edge of the polishing pad and a second region lying closer to the center of polishing pad with a plurality of openings or pores larger than those of the first region. However, the polishing pad of Yu was not designed to be used in polishing a wafer in the overhanging position, and does not solve the problem of gimballing. Both regions of the Yu polishing pad were designed to polish the wafer, albeit at different rates.

None of these prior art pads provide a supporting surface of a material with low polishing characteristics around an interior polishing surface. Such a composite surface would prevent gimballing by supporting the entire surface of the wafer while still exploiting the advantages of the overhanging position without requiring extensive modifications to the existing equipment and processes.

Solution to the Problem

The present invention solves the above problems by working in conjunction with existing polishing platens and, in one embodiment, in conjunction with prior art polishing pads by providing a supporting surface of a material with low polishing characteristics to create a false overhang. More specifically, the present invention, in a preferred embodiment, consists of an outer ring of a low friction material such as TEFLON for mounting on a platen around a conventional polishing pad. By supporting the wafer but not polishing the wafer (due to the surface with low polishing characteristics), the present invention allows the overhanging of the wafer with respect to the polishing surface while preventing gimballing of the wafer carrier. Hence, the present invention provides a novel, cost effective solution to solve the above stated problem without altering proven processes and equipment.

SUMMARY OF THE INVENTION

The present invention provides an apparatus and method for use with a device for polishing a semiconductor wafer. Such devices for polishing semiconductor wafers typically have a rotatable wafer carrier and a polishing pad with a substantially planar surface attached to a rotatable platen. The wafer carrier of said polishing device is movable to place a semiconductor wafer held by the wafer carrier in a contacting and overhanging relationship with the polishing pad. The apparatus of the present invention provides a support for use with such a polishing device to prevent gimballing of the wafer carrier when the wafer held by the wafer carrier is placed in the overhanging and contacting relationship with the polishing pad. The support includes a low polishing substantially planar surface mounted to the polishing device by a means for mounting the support to the device. The low polishing substantially planar surface is mounted to polishing device with the low polishing substantially planar surface and the polishing surface of the polishing pad lying substantially in the same plane when the wafer carrier is rotating. The support apparatus prevents gimballing by supporting the wafer and wafer carrier when the wafer is in the contacting and overhanging relationship with the polishing pad.

In another embodiment, the present invention provides a polishing pad having a circular disk with a substantially planar top surface having an outer circular portion of a material with low polishing characteristics and an inner circular portion of a material suitable for polishing. This embodiment can be of a unitary construction such as a one piece pad having a top surface of two different materials, or can include two distinct members, the first being an outer circular pad having an inner diameter and a substantially planar supporting surface, and the second being an inner circular pad having a diameter less than the inner diameter of the outer circular pad, with the inner circular pad lying within the outer pad.

In another embodiment, the invention is used in conjunction with a prior art polishing pad to provide a false overhang by providing a supporting surface of a material with low polishing characteristics. More specifically, this additional embodiment consists of an outer ring of a low friction material such as TEFLON for mounting on a platen around a conventional polishing pad. By supporting the wafer but not polishing the wafer (due to the surface with low polishing characteristics), this embodiment allows the overhanging of the wafer while preventing gimballing of the wafer carrier.

In another embodiment, the invention provides a process for assembling polishing pads to the circular platen of the polishing device. This process includes providing a polishing pad having an outer diameter and a substantially planar polishing surface of a material suitable for polishing a semiconductor wafer, providing a supporting member having a substantially planar low polishing surface, mounting the polishing pad to the platen, and mounting the supporting member to the platen around the polishing pad with the polishing surface and the low polishing surface lying substantially in the same plane.

In a final embodiment, the invention provides a process for polishing a semiconductor wafer having the steps of providing a rotatable wafer carrier, holding the semiconductor wafer in the rotatable wafer carrier, providing a substantially planar polishing surface of a material suitable for polishing, providing a substantially planar supporting surface in close proximity to the polishing surface, and rotating the semiconductor wafer in contact with the polishing surface with a portion of the semiconductor wafer overhanging the polishing surface and contacting the supporting surface. The supporting surface prevents gimballing by supporting the wafer when it is overhanging the polishing pad. Ordinarily, without the supporting surface, gravity would cause the unsupported wafer carrier and wafer to gimbal.

Hence, the various embodiments of this invention provide a cost effective means to utilize the overhanging position in polishing a semiconductor wafer while avoiding the major disadvantage of gimballing associated with the overhanging position without significantly modifying proven processes and equipment. While the invention has been discussed in the context of the CMP process, it is anticipated that the invention would be useful with any polishing apparatus having a polishing pad mounted to a platen and a rotating carrier holding a circular workpiece. Numerous other features, objects, and advantages of the invention will be apparent from the following description when read together with the accompanying drawings.

BRIEF DESCRIPTION OF THE DRAWINGS

The present invention can be more readily understood in conjunction with the accompanying drawings in which:

FIG. 4(*b*) is a cross sectional view of an additional variation of the preferred embodiment shown in FIG. 3;

DETAILED DESCRIPTION

Overview of the Environment and Prior Art

Figure 1:
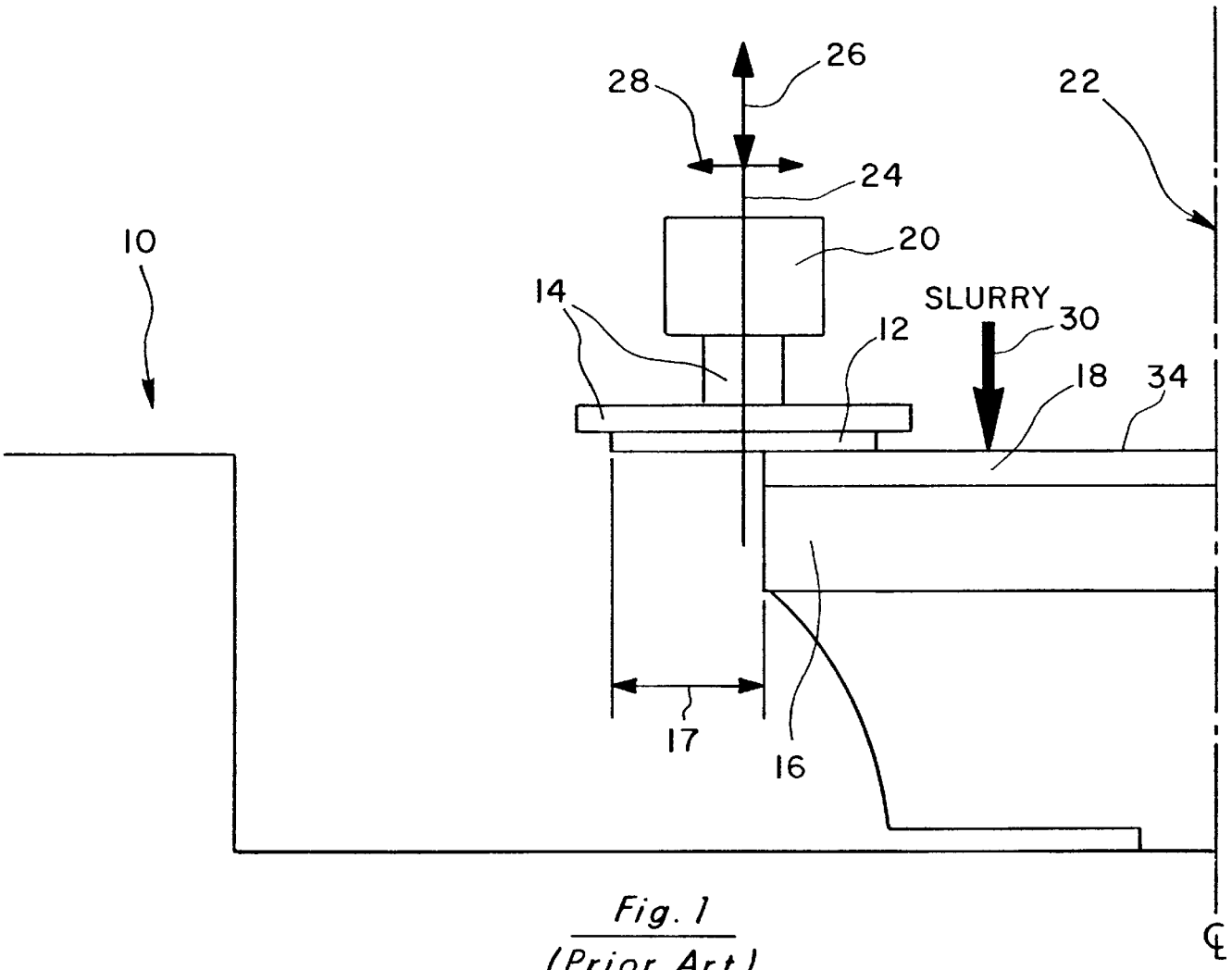
Fig. 1 (Prior Art)
FIG. 1 is a side view of the prior art device for polishing a semiconductor wafer in an overhanging position with respect to the polishing pad of the polishing device.

Referring now to FIG. 1, a device 10 for polishing a semiconductor wafer 12 well known in the prior art is shown. The semiconductor wafer 12 is thin, flat, generally circular in shape, and is formed with microtopography. The semiconductor wafer 12 (also referred to herein as "wafer") may include a substrate such as silicon or oxidized silicon on which a plurality of individual integrated circuits are or will be formed.

The formation of integrated circuits requires the deposition of various films such as metal contacts and resistive and dielectric films on the wafer substrate. During fabrication of the wafer 12, it may be necessary to mechanically or chemically-mechanically polish the surface of the wafer in order, for instance, to provide a planarized topography for definition of these films. This planarization process helps to minimize barriers to multilayer formation and metallization. Additionally, the planarization process smoothes, flattens, and cleans the surface of the wafer. "Polishing", as used herein, includes to all forms of chemical-mechanical polishing, mechanical polishing, and planarization, including cleaning, smoothing, and flattening the surface of the wafer.

The device 10 for polishing semiconductor wafers is well known in the art. Such devices for polishing semiconductor wafers are disclosed in U.S. Pat. Nos. 4,193,226 and 4,811,522. Another such device is manufactured by Westech Systems, Inc. and is designated Model 372 Automatic Wafer Polisher. The device 10 for polishing a semiconductor wafer 12 is intended to be illustrative of such systems. Such devices typically have a wafer carrier 14 rotated about an axis of rotation 24 by a drive means such as a drive motor 20. The wafer carrier 14 securely holds the semiconductor wafer 12 for polishing. The device 10 also has a platen 16 with an axis of rotation 22 on which is mounted a polishing pad 18.

The polishing pad 18 may be formed of a relatively soft material such as polyurethane. More advanced designs for polishing pads are also available, such as those disclosed in the prior art patents disclosed above. The polishing pad 18 is intended herein to represent any one of the conventional prior art polishing pads disclosed in the above referenced patents as well as the simple polyurethane pad (widely regarded as "conventional", See Yu, U.S. Pat. No. 5,329,734), and any variations thereof. The polishing surface 34 of the polishing pad 18 is typically wetted with a lubricant such as water, or an abrasive slurry 30 may be directed onto the surface of the polishing pad 18 to provide an abrasive medium for the wafer 12. Such slurries 30 are well known, and may be formed of a solution or suspension of an abrasive material such as alumina or silica.

In addition to up-and-down movement 26, the wafer carrier 14 is typically mounted for transverse movement 28 across the polishing surface 34 of the polishing pad 18 and the platen 16. This transverse movement 28 allows the semiconductor wafer 12 held by the wafer carrier 14 to be positioned in an overhanging relationship 17 (as shown in FIG. 1) with respect to the outer peripheral edge of the polishing pad 18. As discussed above, this overhanging relationship 17 permits the wafer 12 to be moved on and off the polishing pad 18 to compensate for polishing irregularities caused by the relative velocity differential between the faster moving outer portions and the slower moving inner portions of the wafer 12. However, as discussed above, this overhanging relationship 17 gives rise to the problem of gimballing.

Figure 2:
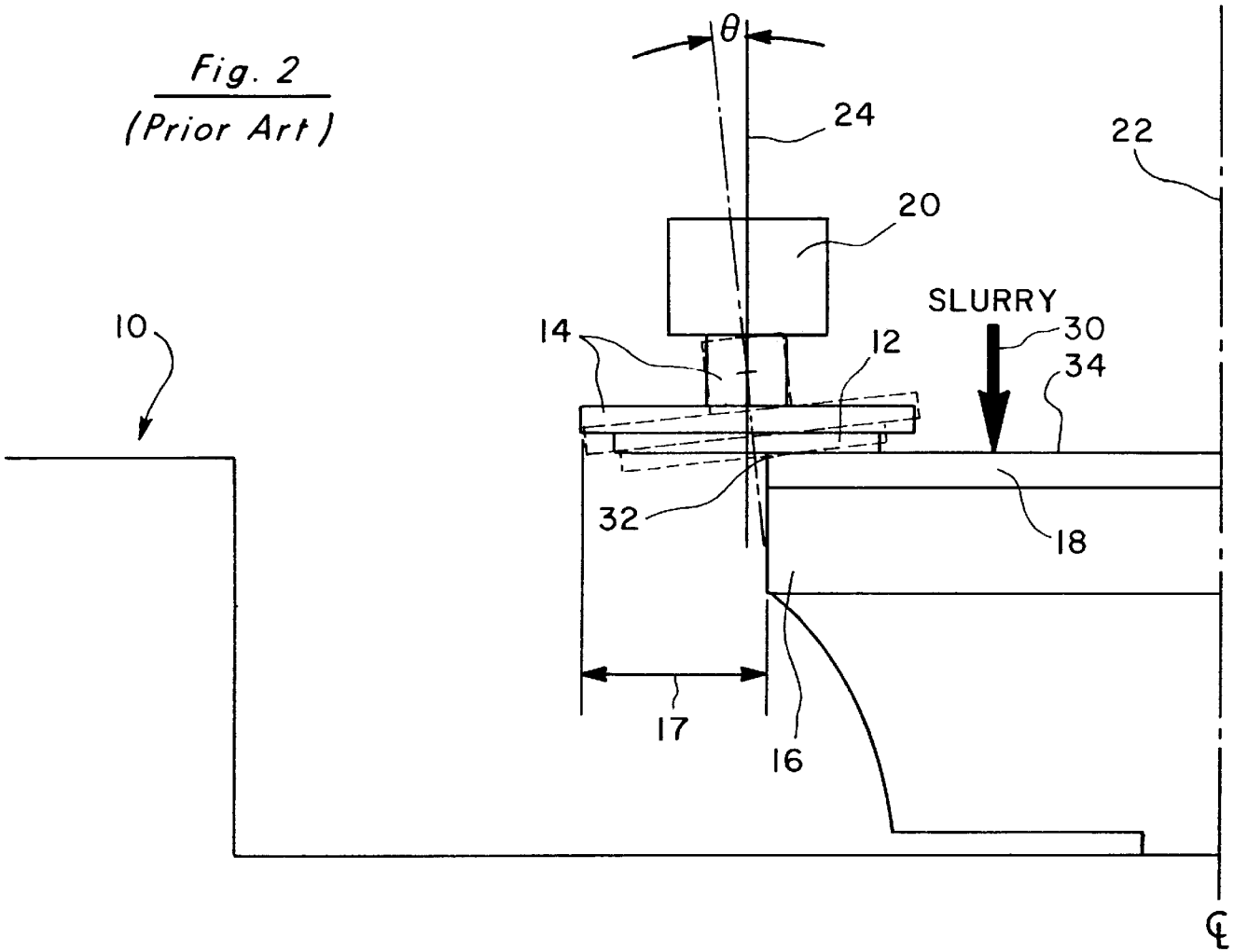
Fig. 2 (Prior Art)
FIG. 2 is a side view of the polishing device of FIG. 1 illustrating gimballing that arises when polishing a semiconductor wafer in the overhanging position.

Gimballing of the wafer carrier 14 and wafer 12 is illustrated in FIG. 2, which illustrates the prior art process of polishing a semiconductor wafer 12 in the overhanging relationship 17 using a polishing pad 18. Gimballing refers to the rotation $\theta$ about an axis perpendicular to the primary axis of rotation 24. Gimballing is due in part because the wafer carrier 14 of the device 10 is typically not rigidly mounted to the drive means 20 to prevent such rotation $\theta$, and is also caused in part by gravity since the wafer 12 and wafer carrier 14 are not completely supported by the polishing pad 18. Furthermore, when polishing in the overhanging position 17, the outer portion of the polishing pad 18 tends to wear faster than the inner portions, this worn portion 32 being illustrated in FIG. 2. Such wear further encourages gimballing.

The following embodiments of the present invention prevent gimballing by providing a support surface 36 for the wafer 12 and wafer carrier 14 when polishing in the overhanging position 17, and also prevent the uneven wear 32 (shown in FIG. 2) of the polishing pad 18. These embodiments, including apparatus and methods, are further described below.

Description of the Preferred Embodiments of the Invention

Figure 3:
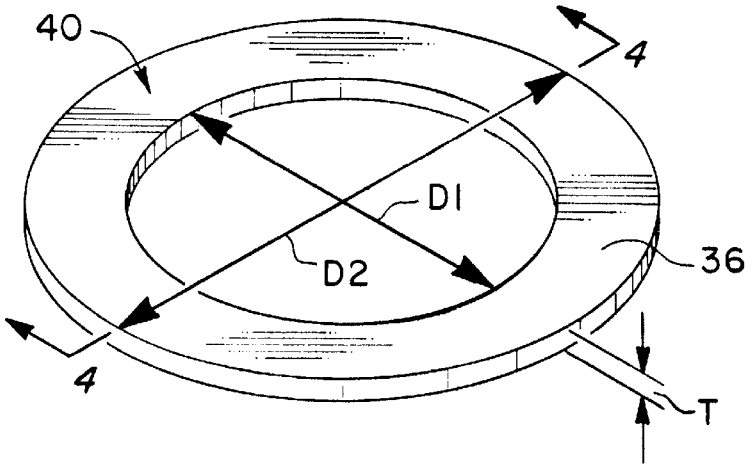
FIG. 3 is a perspective view of the preferred embodiment of the present invention.

The preferred embodiment of the present invention shown in FIG. 3 is a supporting pad 40 for use with the polishing pad 18 of the prior art. Such polishing pads 18 have an outer diameter and a thickness. The supporting pad 40 is a ring having an inner diameter D1, an outer diameter D2, and a thickness T. The supporting pad 40 has a supporting surface 36 of a material with low polishing characteristics. As used herein, "low polishing characteristics" is defined to mean that a surface having such characteristics only slightly alters the workpiece, such as the semiconductor wafer, compared to the conventional polishing surface 34. Ideally, the supporting surface 36 should have substantially no measurable effect on the surface of the semiconductor wafer 12.

In the preferred embodiment, the supporting surface 36 is polytetraflourethylene, and more specifically, the material sold under the tradename TEFLON. This material, TEFLON, was chosen because of its low coefficient of friction, its self lubricating qualities, low cost, and wide availability. However, it is to be expressly understood that a wide variety of polymers as well as nonpolymer materials exhibiting low polishing characteristics could be used. In use, the supporting surface 36 made of TEFLON has substantially no measurable effect on the surface topography of the semiconductor wafer 12 when used as described below and in contact with the wafer 12 for the same amount of time as the polishing surface 34 in a typical polishing cycle.

Figure 4A:
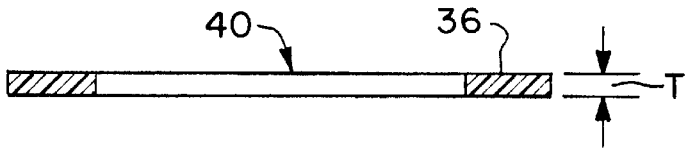
FIG. 4(*a*) is a cross sectional view of the preferred embodiment shown in FIG. 3.
Figure 4B:
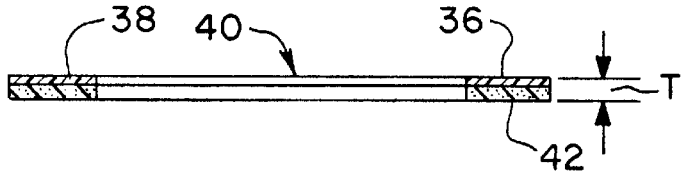

The supporting pad 40 shown in FIG. 3 can be of a unitary or composite construction as shown in FIGS. 4(*a*) and 4(*b*), respectively. The preferred embodiment is the unitary ring of FIG. 4(*a*). The supporting pad 40 of FIG. 4(*a*) has an inner diameter D1 sized larger than the outer diameter of the polishing pad 18. To construct supporting pad 40, a sheet of a material with low polishing characteristics, preferably TEFLON, is provided having a substantially planar surface 36. The sheet should have a thickness (T) substantially the same as that of the polishing pad 18 so that, when mounted to the platen 16 of the device 10 for polishing a semiconductor wafer, the substantially planar supporting surface 36 and the polishing surface 34 lie substantially in the same plane. The sheet is then shaped to form a ring having an inner diameter D1 larger the outer diameter of the polishing pad 18. The resulting supporting pad 40 is then mounted to the platen 16 in a concentric relationship with the polishing pad 18. Typically, an adhesive is used to mount both the supporting pad 40 and the polishing pad 18 to the platen 16.

Figure 10:
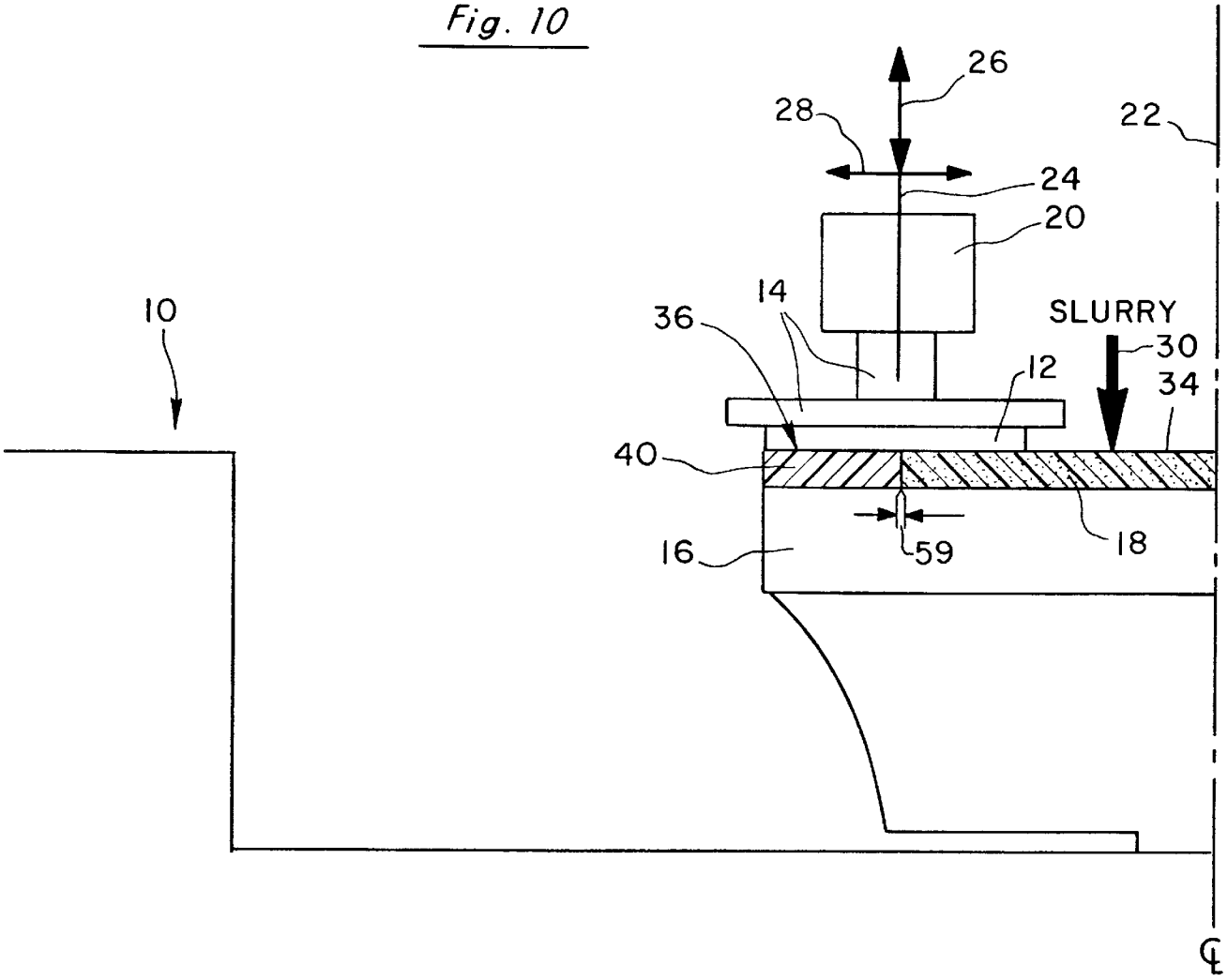
FIG. 10 is a side view of the preferred embodiment shown in FIG. 4(*a*) in use on the prior art polishing device shown in FIG. 1 (both the supporting pad 40 and polishing pad 18 are shown in cross section)

The supporting pad 40 is shown in use in FIG. 10. As illustrated, the supporting pad 40 is used in a process for polishing a semiconductor wafer having the steps of providing a rotatable wafer carrier 14, holding a semiconductor wafer 12 in the rotatable wafer carrier 14, providing a substantially planar polishing surface 34 of a material suitable for polishing the wafer 12, and providing a substantially planar supporting surface 36 of a material with low polishing characteristics in close proximity to the polishing surface 34. In this embodiment the supporting surface 36 is provided by the supporting pad 40. As shown in FIG. 10, (the pads 40, 18 being shown in cross-section) the supporting pad 40 does not overhang the platen 16. Therefore, in using the supporting pad 40, the polishing pad 18 will necessarily be of smaller outer diameter than the polishing pad 18 shown in FIGS. 1 and 2. Since the polishing pad 18 is typically of a unitary piece of polyurethane, the polishing pad 18 can easily be reshaped to a smaller diameter if prefabricated polishing pads 18 of a smaller diameter are not commercially available. The supporting pad 40 has an outside diameter approximately equal to the outside diameter of the platen 16, and an inside diameter equal to or larger than the outside diameter of the polishing pad 18. Whether there is a gap 59 between the pads is not critical as a slight to moderate gap 59 would not affect the supporting function of the supporting pad 40 so long as the substantially planar supporting surface 36 is in close proximity to the polishing surface 34, and both surfaces (34, 36) are substantially in the same plane. In FIG. 10, both the supporting 40 and polishing 18 pads are mounted to the platen 16 using an adhesive well known in the industry.

In use, as shown in FIG. 10, the wafer carrier 14 is moved in the transverse direction 28 closer (compared to the position of the wafer carrier 14 illustrated in FIGS. 1 and 2) to the axis 22 of rotation of the platen 16 so that the wafer 12 is in an overhanging relationship with the polishing surface 34. The wafer carrier 20 is moved downwardly 26 into a contacting relationship with the polishing surface 34 and the supporting surface 36. Both the wafer carrier 14 and platen 16 are rotated about their axes of rotation (24 and 22, respectively) while a slurry 30 may be deposited onto the surface of the polishing pad 18. The supporting pad 40 supports the wafer 12 and wafer carrier 14 at the supporting surface 36 to provide upward support, thereby preventing gimballing, which is caused in part by the lack of support under the wafer 12 in the prior art process (shown in FIG. 2).

Another embodiment of the supporting pad 40 is shown in FIG. 4(*b*). In FIG. 4(*b*), a ring of a composite construction is shown having a substrate 42 of a material such as rubber on which is mounted a thin layer 38 of a material with low polishing characteristics and having a substantially planar supporting surface 36. The total thickness (T) of the embodiment shown in FIG. 4(*b*) should be substantially the same as the thickness of the polishing pad 18 so that the supporting surface 36 and the polishing surface 34 lie substantially in the same plane when mounted to the platen 16.

Alternative Embodiments of the Invention

Figure 5:
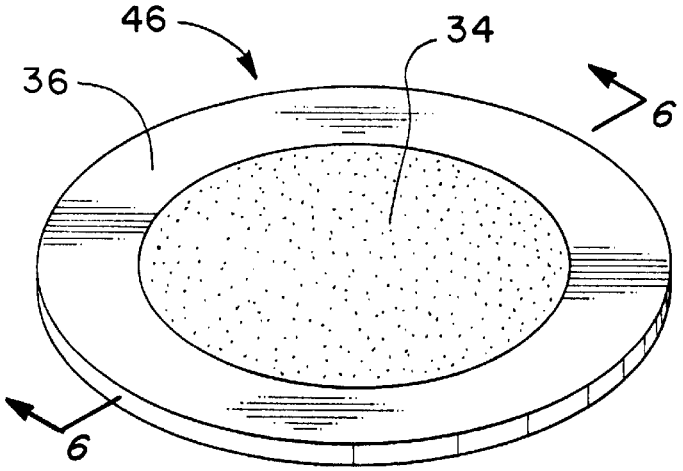
FIG. 5 is a perspective view of an additional embodiment of the present invention.
Figure 6:
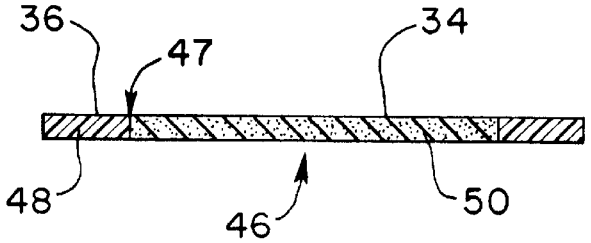
FIG. 6 is a cross sectional view of the embodiment shown in FIG. 5.

An additional embodiment of the present invention is shown in FIG. 5, which illustrates a polishing pad 46 for use on a platen 16 of the device 10 for polishing a semiconductor wafer 12. As further illustrated in the cross sectional view of FIG. 6, the polishing pad 46 is a circular disk with a substantially planar top surface 47 and having an outer circular portion 48 of a material with low polishing characteristics and having a substantially planar supporting surface 36, and an inner circular portion 50 of a material suitable for polishing the semiconductor wafer 12 having a substantially planar polishing surface 34. Preferably, the portion 36 is of TEFLON, and the portion 34 is of the same material as a conventional polishing pad 18 of the prior art described above, such as polyurethane. The outer diameter of the polishing pad 46 should be sized for mounting on the platen 16 using a conventional adhesive. Portions 48 and 50 may or may not be fixedly attached to one another. For instance, portion 48 and portion 50 could be held together by a compression fit thereby forming one polishing pad 46 having an inner circular pad 50 lying within an outer circular pad 48. Alternatively, portions 48 and 50 could be held together by an adhesive. Polishing pad 46 is used similarly to supporting pad 40, except that, in the process described above and illustrated in FIG. 10, the supporting pad 40 and polishing pad 18 would be replaced by the polishing pad 46, thereby providing a substantially planar polishing surface 34 and a substantially planar supporting surface 36.

Figure 7:
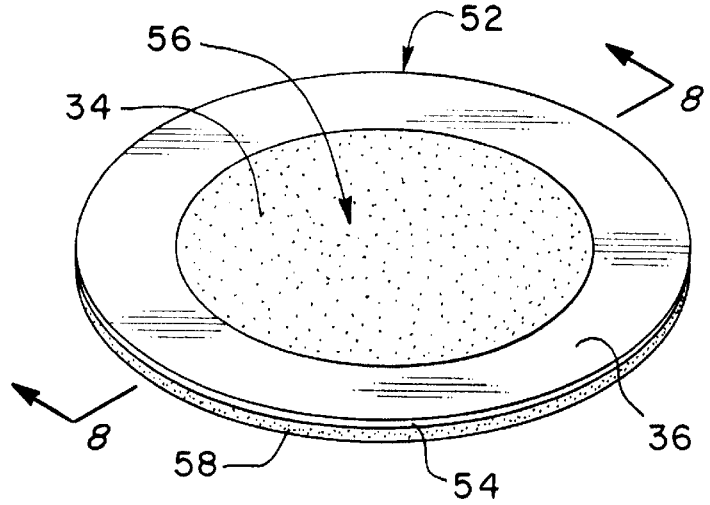
FIG. 7 is a perspective view of an additional embodiment of the present invention.
Figure 8:
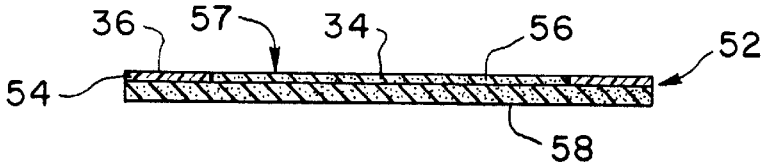
FIG. 8 is a cross sectional view of the embodiment shown in FIG. 7.

An additional embodiment of the present invention is the polishing pad 52 shown in FIG. 7, which is a variation of the polishing pad 46. As more clearly shown in the cross-sectional view of FIG. 8, the polishing pad 52 has a substantially planar top surface 57, a substrate 58 on which is mounted an outer portion 54 of a material with low polishing characteristics and a substantially planar supporting surface 36, and an inner portion 56 of a material suitable for polishing the wafer 12 with a substantially planar top surface 34. Both portions 54, 56 are mounted to the substrate 58. The substrate 58 could be of any material suitable for mounting to the platen 16, such as a hard rubber or relatively firm foam rubber. Portion 54 is preferably made of TEFLON, and portion 56 is of a material used in conventional polishing pads. Thus formed, FIG. 8 illustrates a single polishing pad 52 having a top surface 57 formed by two portions, one having low polishing characteristics 54, and the other 56 being suitable for polishing. The polishing pad 52 is used similarly as polishing pad 46.

Figure 9:
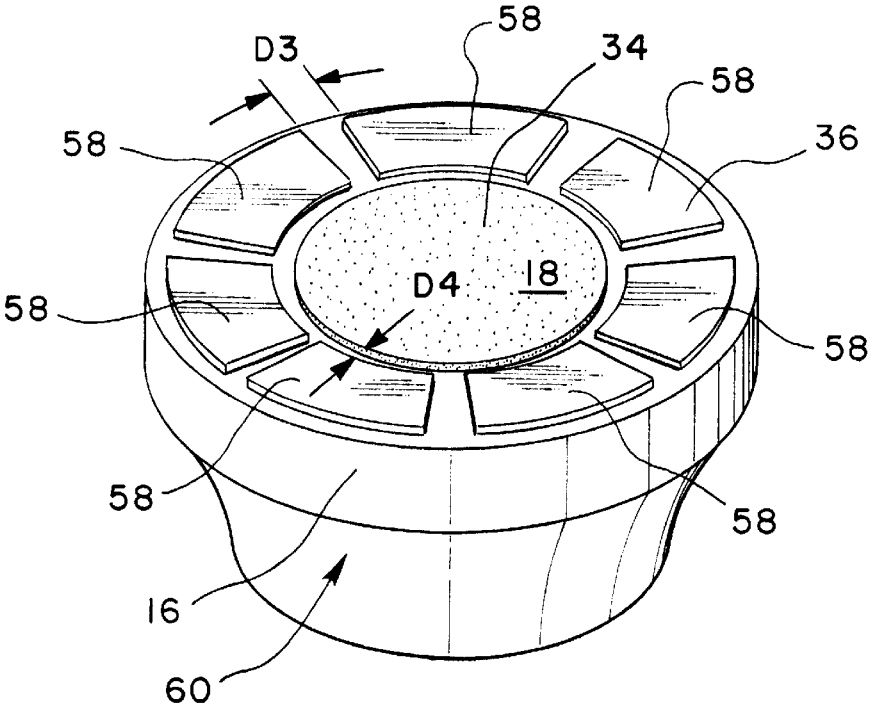
FIG. 9 is an additional embodiment of the present invention.

FIG. 9 illustrates a polishing apparatus 60 having a platen 16, an inner circular pad 18 having a polishing surface 34 suitable for polishing, and at least one supporting member 58 having a supporting surface 36 of material with low polishing characteristics. The inner circular pad 18 is centrally mounted to the platen 16. The supporting member 58 is mounted to the platen 16 with the supporting surface 36 lying substantially in the same plane as the polishing surface 34. The polishing apparatus 60 shown in FIG. 9 has seven supporting members 58. However, it is to be expressly understood that any number of supporting members could be used, from one continuous ring such as described above, to a multitude of smaller sections such as those shown in FIG. 9. Regardless of the number of supporting members, the supporting surface 36 formed by the supporting surface of each individual supporting member 58 must lie substantially in the same plane as the polishing surface 34. The distances D3 and D4 are not critical so long as the wafer and wafer carrier are adequately supported at all times during the overhanging polishing process described above. As in the above embodiments, the preferred material for the supporting surface 36 is TEFLON, although any material having low polishing characteristics relative to the polishing surface 34 could be used. Both the polishing member 18 and the supporting members 58 of the polishing apparatus 60 are mounted to the platen 16 using a conventional adhesive, although any means that securely holds the respective members 58, 18 in place during high speed rotation and that is resistant to the slurry 30 used in the polishing process described above could be used.

Figure 11:
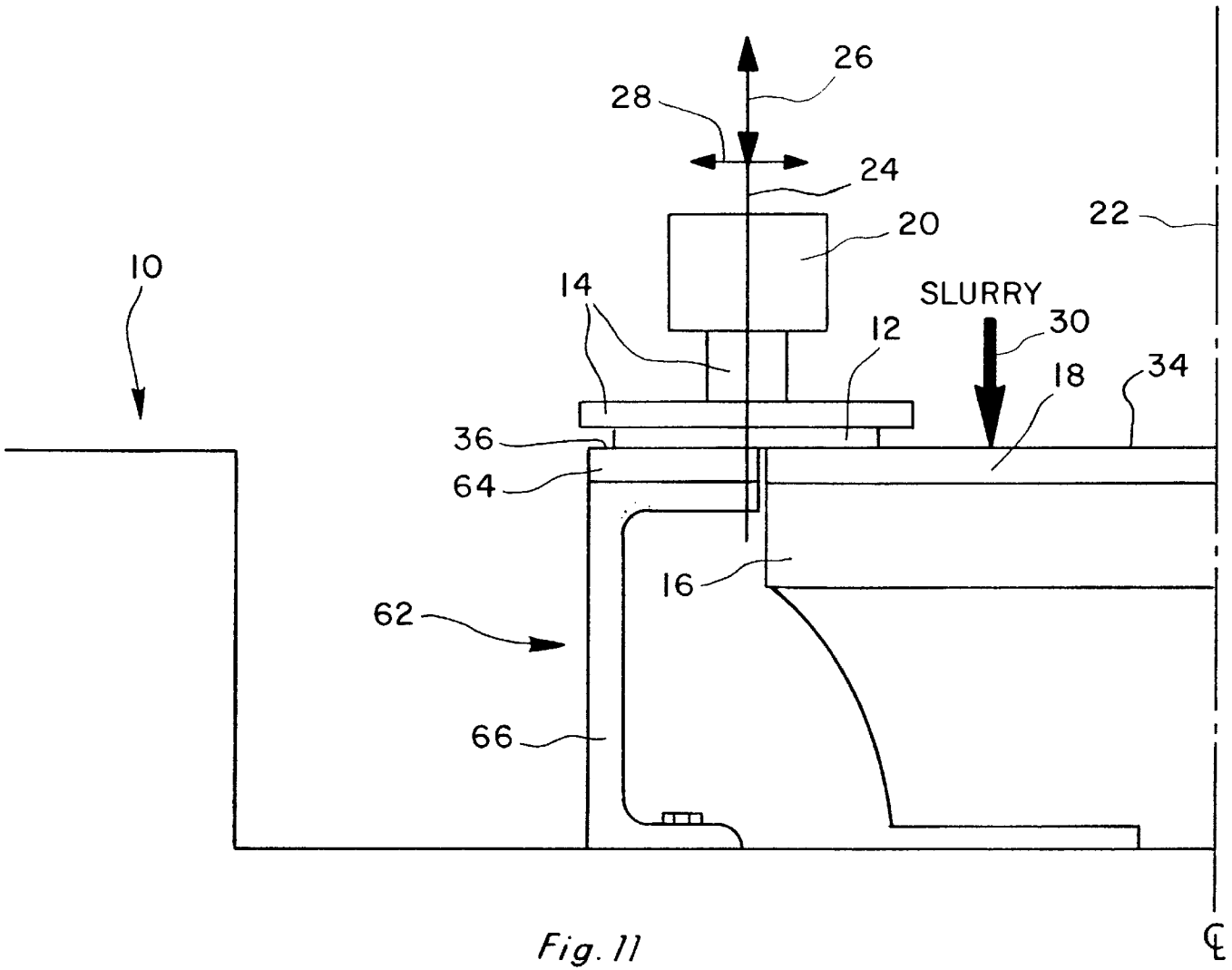
FIG. 11 is a side view of a support means for preventing gimballing mounted on the prior art device for polishing a semiconductor wafer.

While all of the embodiments of the support means described above are intended to be mounted to the platen 16 of the device 10, it is to be expressly understood that the present invention is not limited to those embodiments designed for mounting on the platen 16. For instance, in FIG. 11, a support means 62 for preventing gimballing is shown. The device 10 and process shown in FIG. 11 is identical to that shown in FIGS. 1 and 2. The support means 62 has a support member 64 having a substantially planar support surface 36 of a material with low polishing characteristics. The support means 62 is mounted to the polishing device 10 by a bracket 66, which is mounted to the device 10 so that the support surface 36 lies in substantially the same plane as the polishing surface 34 of the conventional polishing pad 18. The support member 64 is preferably made of TEFLON, although any material with low polishing characteristics could be used. As shown, support member 64 prevents gimballing by providing upward support to the wafer 12 and wafer carrier 14 when the wafer is in the contacting and overhanging position with respect to the polishing pad 18.

There has been described a novel apparatus and method of polishing a semiconductor wafer in an overhanging position relative to a polishing surface without gimballing. The above apparatus and processes can be used with conventional CMP polishing devices and processes currently in place, thereby improving planarization by preventing gimballing and increasing the life of the polishing pads without requiring significant modification of the equipment and processes currently in place. It should be understood that the particular embodiments shown in the drawings and described within this specification are for the purpose of example and should not be construed to limit the invention that will be described in the claims below. Now that a number of examples of the apparatus and methods of the invention have been given, numerous other applications should be evident to one skilled in the art of polishing. Nearly any polishing process where a rotating polishing head can gimbal if used in an overhanging position can be improved by the apparatus and methods of this invention. Further, it is evident that those skilled in the art may now make numerous uses and modifications of the specific embodiments described without departing from the inventive concepts disclosed herein. It should be obvious that the various members described may be made from a variety of materials and using a wide combination of dimensions. Consequently, the invention is to be construed as embracing each and every novel feature and novel combination of the features present in or possessed by the apparatus and processes described herein.

What is claimed is:

1. A support apparatus for use with a device for polishing a semiconductor wafer, said polishing device having a rotatable wafer carrier and a polishing pad with a substantially planar polishing surface attached to a rotatable platen, said wafer carrier being movable to place a semiconductor wafer held by said wafer carrier in a contacting and overhanging relationship with said polishing pad, said support apparatus comprising:

support means for preventing gimballing of said wafer carrier when said wafer held by said wafer carrier is placed in said overhanging and contacting relationship with said polishing pad, said support means having a low polishing substantially planar surface to contact said semiconductor wafer when said support means is mounted to said polishing device with said low polishing substantially planar surface and said polishing surface of said polishing pad lying substantially in the same plane; and means for mounting said support means to said polishing device with said low polishing substantially planar surface of said support means and said planar surface of said polishing pad lying substantially in the same plane when said semiconductor wafer held by said wafer carrier is placed in said overhanging and contacting relationship with said polishing pad when said wafer carrier is rotating;

whereby said support means prevents gimballing by supporting said wafer and said wafer carrier.

2. A polishing pad for use on a platen of a device for polishing a semiconductor wafer, said polishing pad comprising:

a circular disk with a substantially planar top surface having an outer circular portion of a material with low polishing characteristics and an inner circular portion of a material suitable for polishing said semiconductor wafer.

3. The polishing pad of claim 2, wherein said circular disk is unitary in construction.

4. The polishing pad of claim 2, wherein said circular disk includes:

an outer circular pad having an inner diameter and a substantially planar supporting surface; and an inner circular pad, said inner circular pad having an outer diameter less than said inner diameter of said outer circular pad, said inner circular pad having a substantially planar polishing surface, said inner circular pad lying within said outer circular pad;

wherein said top surface is formed by said supporting surface and said polishing surface.

5. The polishing pad of claim 2 further including means for mounting said circular disk to said platen.

6. The polishing pad of claim 2, wherein said outer circular portion of said circular disk is made of a polymer.

7. The polishing pad of claim 6, wherein said polymer is polytetrafluorethylene.

8. The polishing pad of claim 6, wherein said polymer is polytetrafluoroethylene.

9. A supporting pad for use with a polishing pad used in polishing a semiconductor wafer, said polishing pad having an outer diameter and a thickness, said supporting pad comprising:

a ring having an inner diameter greater than said outer diameter of said polishing pad, said ring having a supporting surface of a material with low polishing characteristics.

10. The supporting pad of claim 9, wherein said ring has a thickness substantially equal to said thickness of said polishing pad.

11. The supporting pad of claim 9, wherein said supporting pad has a side opposite said supporting surface, said supporting pad further including an adhesive placed on the side of said ring opposite said supporting surface.

12. The supporting pad of claim 9, wherein said supporting surface is made of a polymer.

13. The supporting pad of claim 12, wherein said polymer is polytetrafluorethylene.

14. The supporting pad of claim 12, wherein said polymer is polytetrafluoroethylene.

15. A polishing apparatus for use in polishing a semiconductor wafer, said polishing apparatus comprising:

a platen;

an inner circular pad centrally mounted to said platen, said inner circular pad having a polishing surface of a material suitable for polishing said semiconductor wafer; and at least one supporting member having a supporting surface of a material with low polishing characteristics mounted to said platen with said supporting surface lying substantially within the same plane as said polishing surface.

16. The polishing apparatus of claim 15, wherein said at least one supporting member is a ring having an inner diameter greater than said outer diameter of said inner circular pad.

17. A method for assembling polishing pads to a circular platen of a device for polishing a semiconductor wafer, said method comprising:

providing a polishing pad having an outer diameter and a substantially planar polishing surface of a material suitable for polishing said semiconductor wafer;

providing a supporting member having a substantially planar low polishing surface;

mounting said polishing pad to said platen of said apparatus for polishing; and mounting said supporting member to said platen around said outer diameter of said polishing pad with said polishing surface and said low polishing surface lying substantially in the same plane.

18. The method of claim 17, wherein said providing a supporting member further includes providing a sheet of a material with low polishing characteristics, said sheet having a substantially planar surface; and shaping said sheet to form a ring having an inner diameter larger than said outer diameter of said polishing pad;

and wherein said mounting said supporting member to said platen further includes mounting said ring to said platen in a concentric relationship with said polishing pad.

19. A process for polishing a semiconductor wafer, said process comprising:

providing a rotatable wafer carrier;

holding the semiconductor wafer in said rotatable wafer carrier;

providing a substantially planar polishing surface of a material suitable for polishing said semiconductor wafer;

providing a substantially planar supporting surface of a material with low polishing characteristics in close proximity to said polishing surface, said supporting surface and said polishing surface lying substantially in the same plane; and rotating said semiconductor wafer in contact with said polishing surface with a portion of said semiconductor wafer overhanging said polishing surface and contacting said supporting surface.

20. The process of claim 19, wherein said providing a substantially planar supporting surface further includes providing a sheet of a material with low polishing characteristics, said sheet having a substantially planar surface; and shaping said sheet to form a ring.

* * * * *